United States Patent [19]

Schwartz

[11] 4,185,613

[45] Jan. 29, 1980

[54] LOG BURNING DEVICE

[76] Inventor: William Schwartz, 9845 Alpine Dr., Kirtland, Ohio 44094

[21] Appl. No.: 848,990

[22] Filed: Nov. 7, 1977

[51] Int. Cl.[2] ..... F23H 9/02

[52] U.S. Cl. ..... 126/181; 126/164

[58] Field of Search ..... 126/181, 298, 164; 198/780; 144/208 E, 246 F, 246 C

[56] References Cited

U.S. PATENT DOCUMENTS

| | | | |
|---|---|---|---|
| 475,628 | 5/1892 | Stombs | 144/246 C |
| 2,026,993 | 1/1936 | McLaine | 126/181 |

*Primary Examiner*—Carroll B. Dority, Jr.

*Attorney, Agent, or Firm*—Baldwin, Egan, Walling & Fetzer

[57] ABSTRACT

A log burning device is presented for holding two logs, each cut in a plane at right angles to the log axis, and the device holding these logs end-to-end to be burned in that position. The device provides shields to true-up the mating ends of the two logs and rotatable rollers support the logs with the rollers being turned by an attached angle handle to move the individual log portions toward and away from each other. A kindling basket is provided to promote the burning action between the two logs.

3 Claims, 7 Drawing Figures

LOG BURNING DEVICE

BACKGROUND OF THE INVENTION

It is traditional to burn logs by fire beneath the log so that the flames eat through the log across the grain until the log is consumed. When a tree grows, channels extending up and down the tree transport growth material from the root system upwardly through and beneath the bark at the same time other material is transported from the leaves to the roots, thus developing channels for transportation. At the end of each year of growth, there is formed an annual ring extending entirely around the trunk. These rings may be counted in the usual manner to determine the age of the tree when it is cut.

An object of the present invention is to provide a log burning device having a structure for supporting two log pieces end-to-end with the mating ends of the logs cut in a plane at right angles to the axis of the log together with means for moving the logs toward and away from each other and a kindling basket in the center of the device for aiding in igniting the burning action of the logs.

Other objects and advantages of this invention will be apparent from the accompanying drawings and description and the essential features thereof will be set forth in the appended claims.

IN THE DRAWINGS

FIG. 6 is a top plan view of one of the rollers seen in FIGS. 1 and 2; while

Figure 1:
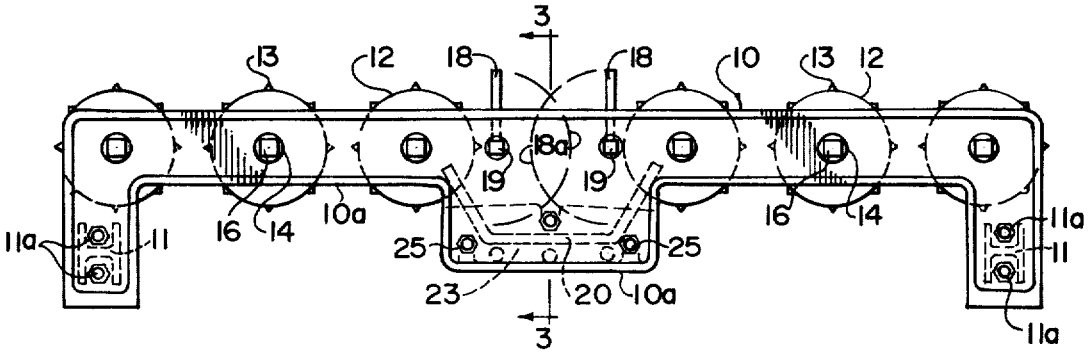
FIG. 1 is a side elevational view of one embodiment of the device.

The log burning device has two rigid side frame members 10 held together in parallel relationship by tie braces 11, seen in FIG. 1, which in the present embodiment are of H section and with two cross bolts 11*a* at each end of the device. The side frame members are strengthened by edge flanges 10*a*, extending around the outer edge of each of the side frame members at right angles thereto. Preferably, these side frame members are metal castings.

Figure 2:
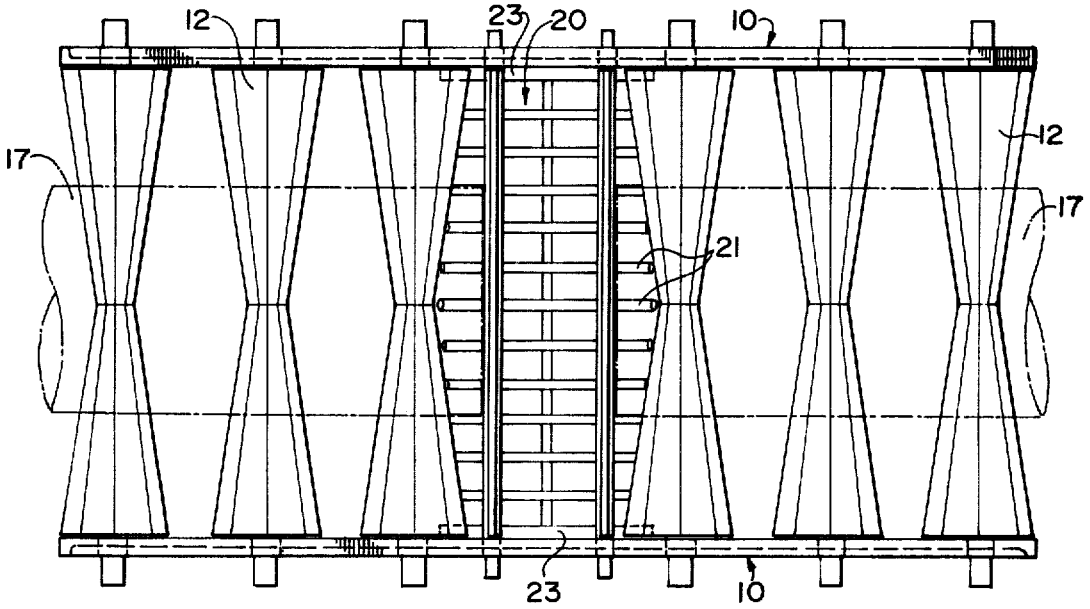
FIG. 2 is a top plan view of the device shown in FIG. 1.
Figure 3:
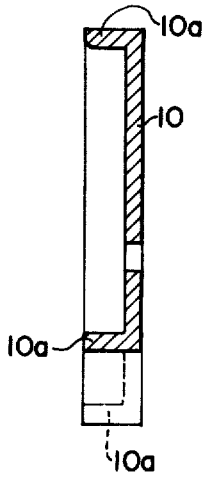
FIG. 3 is a sectional view taken along the line 3—3 of FIG. 1 and showing the cross section of one of the side frame members seen in FIGS. 1 and 2.
Figure 6:
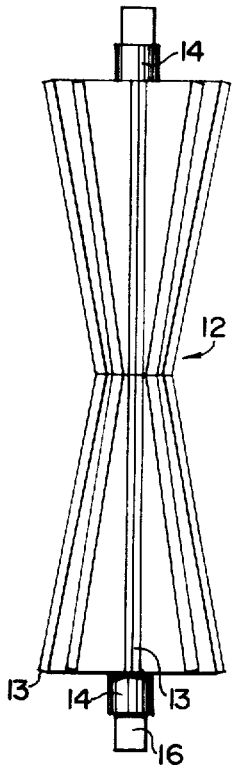

A plurality of longitudinally spaced rollers 12 are mounted for rotation in the side frame members 10 in groups on opposite sides of the center of the frame members. FIGS. 1 and 2 show six such rollers three on each side of the center, as clearly seen in the drawings. These rollers extend substantially the full width between the side frame members and each of the rollers is tapered from each end toward the center, as clearly seen in FIGS. 2 and 6. It will be noted that in FIG. 1 that the rollers at their end portions, extend above the side frame members 10. Each of the rollers have a plurality of longitudinally extending ribs 13 extending radially outwardly usually for not more than about one-eight of an inch. Each of these ribs tapers outwardly to a sharp edge to slightly bite into the logs to prevent slipping. These ribs 13 are evenly spaced about each roller and, as shown in the drawings, they are spaced about 45° apart circumferentially. Each roller has an axial shaft 14 which enters into a suitable opening in the associated side frame member. One or both of the axially extensions terminates in a non-circular, here shown as a square terminal end 16, which is in a position outside of the frame members to receive a complementary non-circular handle by which the rollers 12 may be individually rotated either to push the logs toward or away from the center of the device.

Means is provided to square-up the ends of the mating logs shown in dot-dash lines at 17 in FIG. 2. The facing ends of these logs are cut-off in planes at right angles to the axial dimension of the logs so as to present two parallel faces at the center of the device. The means provided for squaring off the position of the logs in the burning device herein consists of two shields 18 which extend across the full width of the device encompassed by the side frame members and which are mounted on turning axes 19 which are rotatably mounted in the side frame members. It will be noted that the shields 18 extend above the level of the top of the ends of the rollers 12 in FIG. 1 so as to engage the ends of logs riding on the rollers 12. After the logs start burning, the shields 18 turned in the vertically upward position, shown in FIG. 1, give some protection to the lower sides of the burning logs to prevent them burning away more quickly at the bottom than at the top. Screens 18 are held in position by friction at pivots 19.

Figure 4:
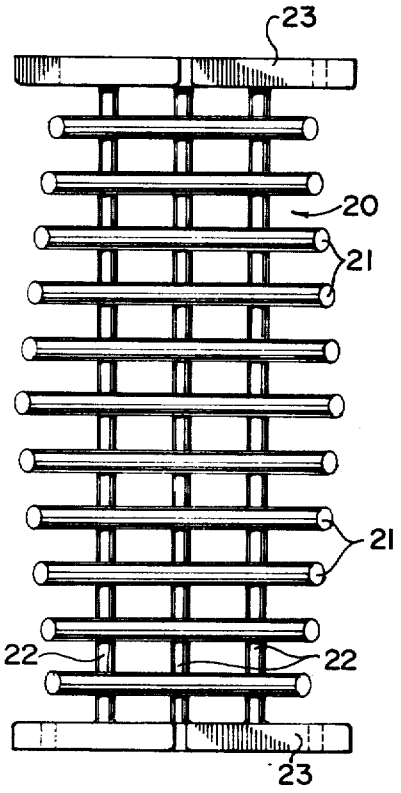
FIG. 4 is a top plan view of the kindling basket shown in the center of FIG. 2.
Figure 5:
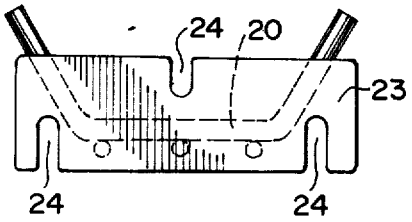
FIG. 5 is an end view of FIG. 4.
Figure 7:
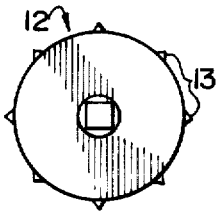
FIG. 7 is an end view of the roller of FIG. 6

A kindling basket is shown in FIGS. 2, 4 and 5 which preferably is spaced in the center of the device as shown in FIGS. 1 and 2 so as to aid in starting the fire between the two adjacent ends of the burning logs 17. This kindling basket 20 is best seen FIGS. 1, 2, 4 and 5. It consists of a plurality of parallel cross-bars 21 each of truncated V-shape, opening upwardly, and extending longitudinally of the side frame members 10. As seen in FIGS. 2 and 4, the cross-bars are longer in the center of the device and taper progressively laterally towards each end so that the ends of the cross-bars conform to the shape of the adjacent rollers, as clearly seen in FIG. 2.

A plurality of parallel grate bars extend normally to the cross-bars and are welded thereto. These are indicated at 22. End plates 23 are seen at the opposite ends of the kindling basket and the grate bars 22 are welded to the end plates. Through openings 24 in the end plates are passed bolts 25 which firmly secure the end plates to the adjacent side frame member 10.

In use, the logs 17 are cut at one end in a plane crosswise of the log, they are then placed on the rollers 12, with the cut ends facing each other, and a crank placed on the square end 16 of one or more of the rollers may be operated to move the logs toward each other and against the shields 18. A kindling is then placed in the basket 20 and the fire is started which quickly spreads to the facing ends of the logs 17. Logs burned in this device create a greater amount of heat than is usually generated when logs are burned in the conventional manner by fire applied to the longer dimension of the log. It also generates a higher temperature and the burning rate can be controlled by manipulation of the rollers 12. This burning device calls for less maintenance and is very adaptable for the use of burning logs of various sizes and materials.

A great deal of time and energy is expended in a conventional burning procedure, for all the cambium walls must be penetrated separately, whereas, when the logs are burned as in this invention with the grain following the channels between cambium layers there is no loss of time or energy once the logs are ignited to a self-propulsion stage.

What is claimed is:

1. A log burning device comprising two parallel rigid side frame members, rigid tie braces secured between said frame members, a plurality of longitudinally spaced rollers mounted independently for individual rotation in said side frame members in groups on opposite sides of the center of said frame members, said rollers extending substantially the full width between said side frame members, each of said rollers tapered from each end toward the center, said rollers at their ends extending above said frame members, each of said rollers having a plurality of longitudinally extending ribs extending radially outwardly for not more than about one-eight of an inch, each rib tapering outwardly to a sharp edge, said ribs evenly spaced circumferentially about said rolls, and each of said rolls having rigid therewith an axial extension laterally outwardly beyond an associated side frame member, said extension non-circular to receive a complementary non-circular handle, whereby the groups on opposite sides of the center may be rotated toward or away from the center, the center of said frame members between said groups of rollers being slightly wider than the spacing of adjacent rollers in said groups, and two planar parallel shields mounted in said frame members, one close to each of said innermost rollers of each of said groups, said shields extending above the top level of the outer ends of said rollers.

2. A log burning device as defined in claim 1, including a kindling basket of a width adapted to fit in said center space and of a length to enter from one side frame member to the other frame member, and means to firmly attach said basket to said frame members.

3. A log burning device as defined in claim 2, wherein said kindling basket consists of a plurality of parallel cross-bars each of truncated V-shape opening upwardly and longitudinally of said frame members, said cross-bars being longer in the center of said device and tapering progressively laterally toward each end so that the ends of said cross-bars conform to the shape of adjacent rollers, a plurality of parallel grate bars extending normally to said cross-bars and welded thereto, end plates one at each end of said grate bars and welded thereto, and means firmly securing said end plates to said side frame members.

* * * * *